US005804038A

United States Patent [19]

Nelsen

[11] Patent Number: 5,804,038

[45] Date of Patent: Sep. 8, 1998

[54] REDUCTION OF METAL STRESSES IN DELAYED COKING DRUMS

[75] Inventor: David K. Nelsen, Ponca City, Okla.

[73] Assignee: Conoco Inc., Ponca City, Okla.

[21] Appl. No.: 925,229

[22] Filed: Sep. 8, 1997

[51] Int. Cl.[6] ..... C10B 39/00; C10B 45/00; C10B 29/00

[52] U.S. Cl. ..... 201/39; 201/43; 202/227; 202/267.1; 202/270; 208/131

[58] Field of Search ..... 201/39, 43; 202/227, 202/270; 208/131, 267.1

[56] References Cited

U.S. PATENT DOCUMENTS 4,634,500 1/1987 Elliot et al. ..... 201/39
5,628,603 5/1997 Antalffy et al. ..... 414/216

*Primary Examiner*—Nina Bhat

[57] ABSTRACT

The metal stresses in a delayed coke drum are reduced by externally cooling the coke drum near the junction of the drum shell and the supporting skirt thereof during the quench step. This reduces the metal stresses at the area around the welds of the drum skirt.

8 Claims, 3 Drawing Sheets

COKE DRUM SCHEDULE
18 HOUR CYCLE

| TIME (HRS) | DRUM 1 | DRUM 2 | TIME (HRS) |
|---|---|---|---|
| 18 | COKE FILL | STEAMOUT | 1 |
| | | QUENCH | 4 |
| | | DRAIN | 1.5 |
| | | UNHEAD/PILOT HOLE | 1 |
| | | DRILL | 4.5 |
| | | REDHEAD | 0.5 |
| | | WARM-UP TEST | 5.5 |
| 1 | STEAMOUT | COKE FILL | 18 |
| 4 | QUENCH | | |
| 1.5 | DRAIN | | |
| 1 | UNHEAD/PILOT HOLE | | |
| 4.5 | DRILL | | |
| 0.5 | REDHEAD | | |
| 5.5 | WARM-UP TEST | | |

FIG. 2

REDUCTION OF METAL STRESSES IN DELAYED COKING DRUMS

BACKGROUND OF THE INVENTION

1. Field of the Invention

This invention relates to delayed coking, and more particularly to a method of reducing the metal stresses in delayed coking drums during the cooling and quenching part of the coking cycle.

In a typical delayed coker unit, a pair of coke drums are alternately filled and emptied, with coker feed being pumped into one of the drums while the other drum is being emptied of coke and prepared for the next filling cycle.

2. Background Art

A conventional coking operation includes, in the process of emptying the filled drum, the steps of steaming out the filled drum to remove residual volatile material from the drum, quenching the steamed out coke bed with water, draining quench water from the drum, opening the top and bottom of the coke drum (unheading the drum), drilling a pilot hole in the coke bed from the top, drilling out the remaining coke with a radially directed water jet drill, removing the drilled out coke from the bottom of the drum, closing the top and bottom openings of the coke drum, and preheating the empty coke drum by passing hot vapors from the other drum being filled with hot coker feed. The preheating step is necessary to bring the empty coke drum temperature up prior to switching the hot coker feed to the recently emptied drum, as otherwise the thermal stresses from feeding hot feed into a relatively cool drum would cause serious damage. In my copending U.S. patent application U.S. Ser. No. 08/879,573, filed on Jun. 20, 1997, a method of reducing the time required for the preheating step is described. That method includes the application of external heat to a critical area of the coke drum during the preheat step of the coking cycle.

A typical coke drum is supported by a skirt which is welded to the drum near the junction of the drum shell and the lower cone of the drum. As described in my aforementioned U.S. patent application, the maximum thermal stresses occur at the time the hot oil feed, at about 900° F., is switched to the preheated drum. These thermal stresses are partly due to the fact that the interior surface of the preheated drum is hotter than the exterior of the drum, including the area where the supporting skirt is welded to the drum shell. The expansion rate of the interior of the shell, upon being contacted with hot oil feed, is initially greater than the expansion rate of the cooler exterior portion. If sufficient time is available, the preheat step can be carried out over a time period sufficient to heat the drum exterior to a temperature near that of the drum interior. However, this is a problem if preheat time is to be minimized in order to reduce the overall cycle time.

There is another point in the coking cycle during which high metal stresses develop in the area of the junction between the coke drum and its supporting skirt. This occurs when quench water is introduced into the drum to quench the steamed out coke. At the time the quench water is introduced, the drum exterior is much hotter than the quench water, and the temperature differential between the drum interior and the drum exterior sets up large thermal gradients which result in high metal stresses. This is particularly critical in the area of the drum where the supporting skirt is attached. The top portion of the support skirt remains at a higher temperature than the cooling cone and shell. The resulting temperature differences in the components results in the cone and shell contracting at a faster rate than the skirt. The differential of expansion rates creates high metal stresses when the contracting cone and shell pull away from the hotter skirt.

SUMMARY OF THE INVENTION

According to the present invention, the metal stresses in a coke drum during the quenching step of the coking cycle are reduced by applying a cooling fluid to the external part of the coke drum adjacent the area where the drum and its supporting skirt are connected. This external cooling fluid reduces the temperature differential between the drum interior and the supporting skirt connection, thereby reducing the metal stresses during the quenching step.

DESCRIPTION OF THE DRAWINGS

FIG. 2 is a chart showing the coke drum schedule for a coking cycle.

FIG. 6 is a cross section showing a coke drum supported by a skirt welded to the shell of the drum.

DESCRIPTION OF THE PREFERRED EMBODIMENTS

The primary object of the present invention is to decrease the metal stresses in a coke drum during the quenching step of the coke cycle.

Figure 1:
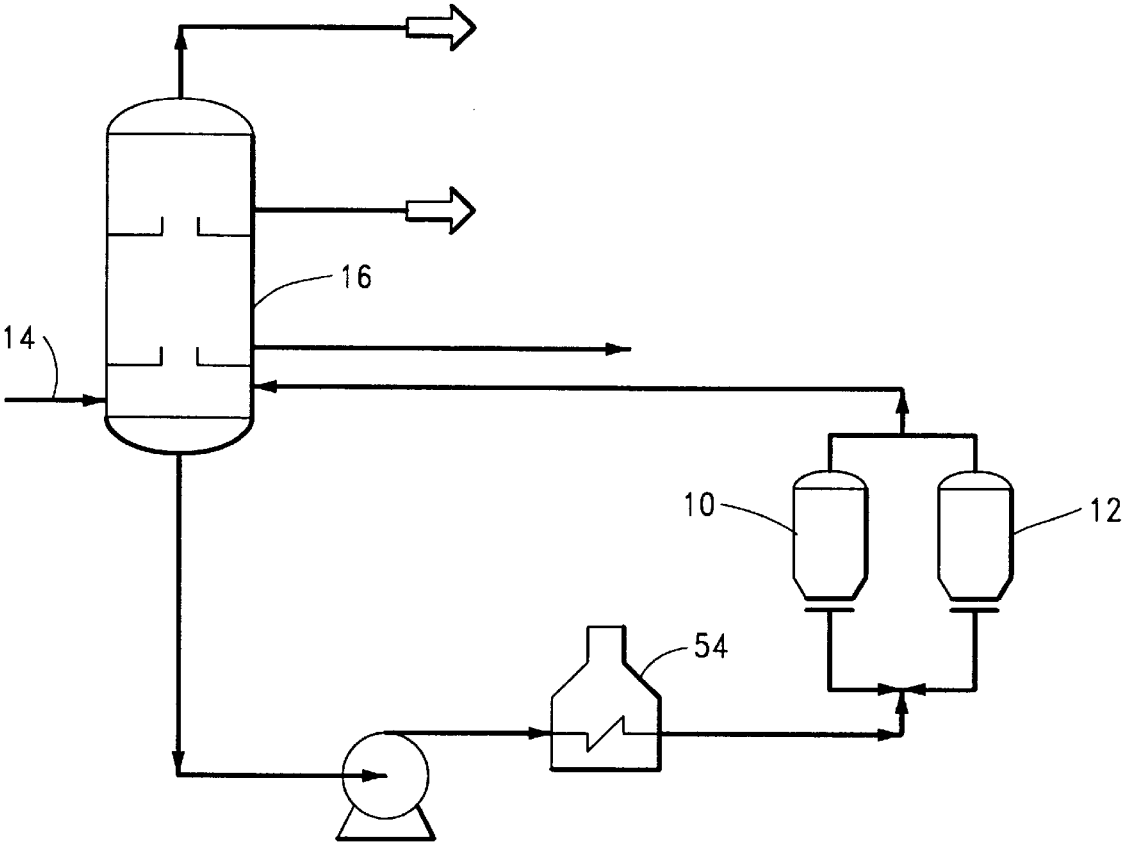
FIG. 1 is a schematic view of a delayed coker unit showing a pair of coke drums and associated equipment.

FIG. 1 shows a typical coker unit comprised of a pair of coke drums 10 and 12. Coker feed from feed line 14 enters coker fractionator 16 and is pumped to furnace 54 and then fed to one of the coke drums. Overhead vapors from the drum being filled return to fractionator 16 where they are separated into product streams.

Referring to FIG. 2, a typical cycle schedule is shown. The example illustrated is for an eighteen hour cycle, but longer and shorter cycles are common.

Figure 3:
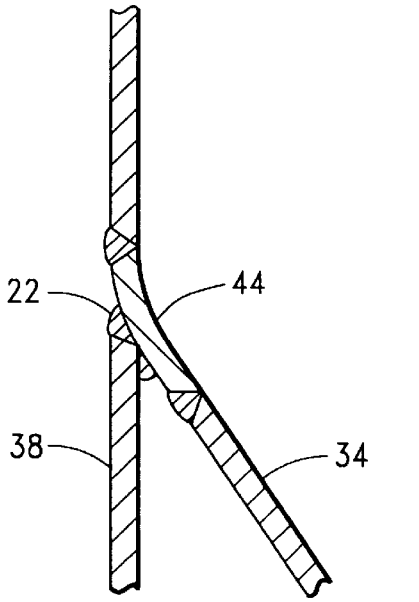
FIG. 3 is a side elevation, partly in cross section, showing details of a coke drum and its supporting structure.

The means for applying external cooling fluid to the drum are best shown in FIG. 3. A cooling fluid jacket 48 encircles drum 10 around the area of the skirt-to-drum junction. A cooling fluid inlet 50 and outlet 52 are provided for passing cooling fluid, preferably water or low pressure steam, through the cooling jacket 48.

As seen in FIG. 3, a coke drum 10 includes a bottom cone section 34 and a removable lower plate 36. Between the drum shell and the bottom cone section 34 there is a transition or knuckle section 44. As shown in FIGS. 3 and 6, near the junction of the drum shell and knuckle section 44, a supporting skirt 38 is welded to the drum, in what is sometimes referred to as a tangent line connection.

Figure 5:
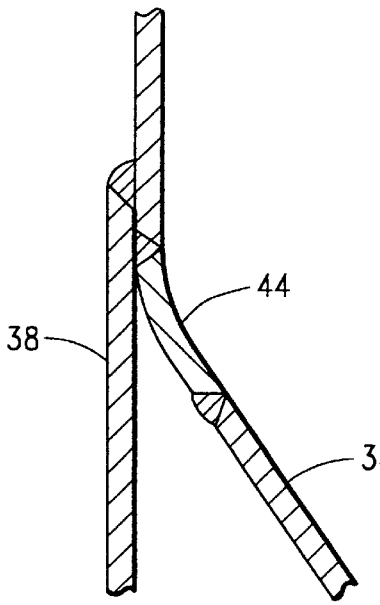
FIG. 5 is a cross section showing a coke drum supported by a skirt welded to the knuckle section on the cone of the drum.
Figure 3:
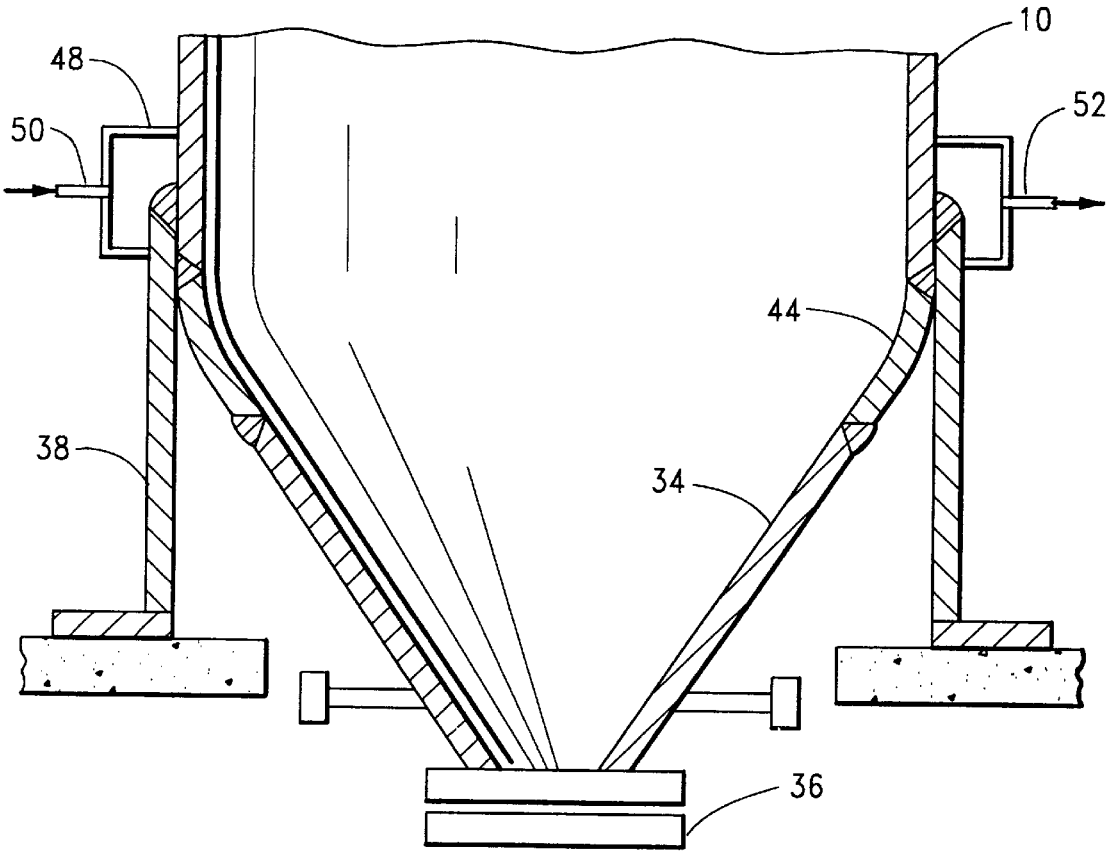

As shown in FIG. 5, a knuckle section 44 is welded between the drum shell and lower cone section 34. A supporting skirt 38 is welded to the knuckle section 44 at weld 22, in what is sometimes referred to as a knuckle connection.

Figure 4:
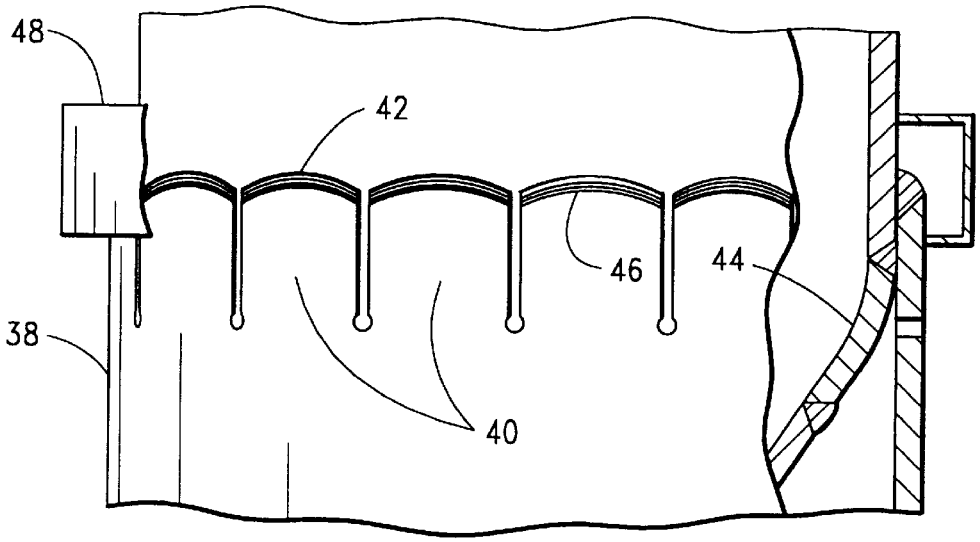
FIG. 4 is a side elevation, partially cut away, showing details of the junction of a coke drum and its supporting skirt.

In one popular variation as shown in FIG. 4, the skirt includes a series of fingers 40 formed by slots extending from the top of the skirt, and each finger has a curved top 46 to present a scalloped shape, and the curved finger tops are welded to the drum shell. It is common to include rounded lower ends in slots in the skirt to prevent stress risers from forming at the slot ends. In cases where the cooling jacket 48 extends over part of the slots extending from the top of the skirt as shown in FIG. 4, it may be desirable to apply a packing material in the slots to prevent leakage of cooling fluid.

Whichever type of skirt-to-drum system is used, the junction between the drum shell and skirt is very hot when the quench step is initiated. The exterior drum surface, and especially the welded junction of the drum shell and the supporting skirt, does not cool down at the same rate as the interior of the drum. High metal stresses then develop because of the thermal shock that occurs when quench water is introduced into the bottom of the drum. This thermal shock can potentially damage the skirt-to-drum connection.

To illustrate the process of the invention, the coking cycle including the use of external drum cooling will now be described with reference to FIGS. 1 and 3.

Hot coker feed from furnace 54 is fed to the bottom of coke drum 10. At the time feed to drum 10 is initiated, coke drum 12, which is full of coke, is steamed with low pressure steam to strip residual volatile hydrocarbons from the coke bed in the drum. The steam also removes some heat from the coke. After the steamout step, the coke is quenched by filling the drum with quench water. Before the thermal gradient caused by the quench water reaches the level of the drum-to-skirt connection, a cooling fluid such as water, air or other gas, or low pressure steam, is injected into cooling jacket 48 from inlet 50. The cooling fluid exits outlet 50, providing external cooling to the drum at the area of the drum-to-skirt junction, and reducing the metal stresses in the drum. Once the coke bed is covered with water, the drum drain is opened and water is drained out. The top and bottom drum head covers are then removed. A pilot hole is drilled through the coke bed from the top, and then a rotating high pressure water jet drill passing down through the pilot hole directs a cutting stream horizontally against the coke bed. The drilled out coke falls downwardly out of the drum. After the coke cutting is completed and the coke has been removed from the drum, the head covers are reinstalled and the drum is purged with steam and tested for leaks. Part of the hot vapor from the top of the on-line drum is diverted into the cleaned drum to warm the drum to a predetermined temperature. Hot feed from furnace 54 is then switched into the cleaned drum.

The essence of the invention is in externally applying cooling fluid to the junction of the coke drum and its supporting skirt during and/or prior to introducing quench water into the drum. The application of external cooling fluid allows the area of the drum-to-skirt junction to more nearly approach the temperature of the drum interior during the quench step, and allows the introduction of quench water without the damaging metal stresses that would result if the exterior of the drum, particularly around the drum-to-skirt welds, is at a much higher temperature than the quench water.

The foregoing description of the preferred embodiments of the invention is intended to be illustrative rather than limiting of the scope of the invention, which is to be defined by the appended claims.

I claim:

1. In a delayed coking process in which a pair of coke drums each supported by a skirt section welded to said drum are alternately filled and emptied, and in which the emptying portion of the cycle comprises the steps of:

(a) steaming out the filled coke drum to remove residual volatile matter from the drum;

(b) quenching the hot coke bed with water;

(c) draining quench water from the coke drum;

(d) opening the top of the coke drum and drilling a pilot hole through the coke bed therein;

(e) drilling out the coke from the coke bed between the pilot hole and the coke drum wall by radially directed drill water and removing the coke through an opening in the bottom of the coke drum;

(f) closing the top and bottom openings of the coke drum; and (g) prior to introducing feed into the emptied drum, preheating the empty drum by passing hot coke drum vapors through the drum;

the improvement wherein the metal stresses at the junction of the coke drum and skirt are reduced by applying cooling fluid to the exterior portion of said coke drum adjacent the junction of the drum shell and the skirt of said drum during the introduction of quench water into said drum, thereby preventing excessive thermal stresses.

2. The process of claim 1 wherein said cooling fluid is applied to the exterior of said drum during the introduction of quench water by utilizing a cooling jacket surrounding said drum near the junction of the shell and the supporting skirt thereof.

3. The process of claim 2 wherein said cooling fluid is a gas.

4. The process of claim 3 wherein said cooling fluid is air.

5. The process of claim 3 wherein said cooling fluid is low pressure steam.

6. The process of claim 2 wherein said cooling fluid is a liquid.

7. The process of claim 6 wherein said cooling fluid is water.

8. A method for reducing metal stresses in a coke drum which occur during the quenching step comprising applying a cooling fluid to the external part of the coke drum adjacent to the area where the coke drum and the coke drum supporting skirt are connected, reducing the temperature differential between the drum interior and the supporting skirt connection thereby reducing metal stressed during the quenching step.

* * * * *

UNITED STATES PATENT AND TRADEMARK OFFICE

CERTIFICATE OF CORRECTION

PATENT NO.: 5,804,038

DATED: September 8, 1998

INVENTOR(S): David K. Nelsen

It is certified that error appears in the above-identified patent and that said Letters Patent is hereby corrected as shown below:

In Claim 8, at Column 4, line 56, --stressed-- should be --stresses--.

Signed and Sealed this

Sixth Day of March, 2001

*Attest:*

Nicholas P. Godici

NICHOLAS P. GODICI

*Attesting Officer*

*Acting Director of the United States Patent and Trademark Office*